US008063342B2

(12) United States Patent
Hines, Jr.

(10) Patent No.: US 8,063,342 B2
(45) Date of Patent: Nov. 22, 2011

(54) COOKING OVEN

(76) Inventor: Robert Stickley Hines, Jr., Unicoi, TN (US)

( * ) Notice: Subject to any disclaimer, the term of this patent is extended or adjusted under 35 U.S.C. 154(b) by 623 days.

(21) Appl. No.: 12/278,454

(22) PCT Filed: Feb. 2, 2007

(86) PCT No.: PCT/US2007/002829

§ 371 (c)(1),
(2), (4) Date: Oct. 1, 2008

(87) PCT Pub. No.: WO2007/092280

PCT Pub. Date: Aug. 16, 2007

(65) Prior Publication Data

US 2009/0065493 A1 Mar. 12, 2009

Related U.S. Application Data

(63) Continuation-in-part of application No. 11/347,982, filed on Feb. 6, 2006, now abandoned.

(60) Provisional application No. 60/661,618, filed on Mar. 14, 2005, provisional application No. 60/693,882, filed on Jun. 24, 2005, provisional application No. 60/839,643, filed on Aug. 23, 2006.

(51) Int. Cl.

| | |
|---|---|
| ***F27D 11/02*** | (2006.01) |
| ***F24C 15/32*** | (2006.01) |
| ***A21B 1/14*** | (2006.01) |
| ***A21B 1/26*** | (2006.01) |

(52) U.S. Cl. ..... 219/400; 219/394; 219/395; 219/399; 219/407; 219/411; 126/21 A

(58) Field of Classification Search ..... None
See application file for complete search history.

(56) References Cited

U.S. PATENT DOCUMENTS

| | | | | |
|---|---|---|---|---|
| 2,994,760 | A * | 8/1961 | Pecoraro et al. | 219/394 |
| 3,041,440 | A | 6/1962 | Dills | |
| 3,726,578 | A | 4/1973 | Armstrong | |
| 4,096,369 | A * | 6/1978 | Tanaka et al. | 219/741 |
| 4,215,266 | A * | 7/1980 | Smith et al. | 219/413 |
| 4,585,923 | A | 4/1986 | Binder | |
| 4,780,597 | A * | 10/1988 | Linhart et al. | 219/404 |
| 4,829,158 | A * | 5/1989 | Burnham | 219/400 |
| 5,204,503 | A | 4/1993 | Maiellano et al. | |
| 5,205,273 | A * | 4/1993 | Sparks et al. | 126/21 A |
| 5,309,981 | A * | 5/1994 | Binder | 165/64 |

(Continued)

FOREIGN PATENT DOCUMENTS

JP 63-172838 A 7/1988

*Primary Examiner* — Joseph M Pelham

(57) ABSTRACT

A cooking structure which provide for two or more side-by-side ovens separated by vertical, movable, hinged partition(s) whereby the oven structure may function as one large oven or as two or more smaller independent ovens, wherein for each oven a tangential fan blows air substantially evenly over upper electrical heating elements strung generally from side-to-side of the oven, wherein a flow director (baffle) structure functions as a radiant heat shield which is operator movable to either expose to or occlude from the oven cooking chamber the direct radiation from its heating elements, depending on the need to roast, bake, or broil the food product. Also provided are lower electrical heating elements positioned below a ceramic cooking surface for ensuring evenness of radiant heat transfer therefrom. Also provided is operator controlled top vs. bottom heating using a slide control that reciprocally affects the duty cycle of the top and bottom electrical heating elements, further allowing precision baking control.

10 Claims, 9 Drawing Sheets

U.S. PATENT DOCUMENTS 5,379,685 A * 1/1995 Krasznai ..... 99/389
5,451,744 A 9/1995 Koopman et al.
5,618,458 A * 4/1997 Thomas ..... 219/394
5,695,668 A 12/1997 Boddy
5,738,081 A 4/1998 Puricelli
6,307,185 B1 10/2001 Loveless
6,545,251 B2 4/2003 Allera et al.
6,552,305 B2 4/2003 De'Longhi
7,060,940 B2 6/2006 Kim et al.
7,071,448 B1 * 7/2006 Kim et al. ..... 219/394
7,087,863 B1 * 8/2006 Kim et al. ..... 219/394
7,129,447 B1 * 10/2006 Kim et al. ..... 219/394
7,183,520 B2 * 2/2007 Park ..... 219/394
7,297,905 B2 * 11/2007 Kim et al. ..... 219/400
7,642,488 B2 * 1/2010 Kim et al. ..... 219/400

* cited by examiner

Fig.6B
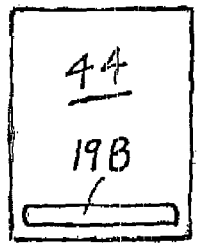
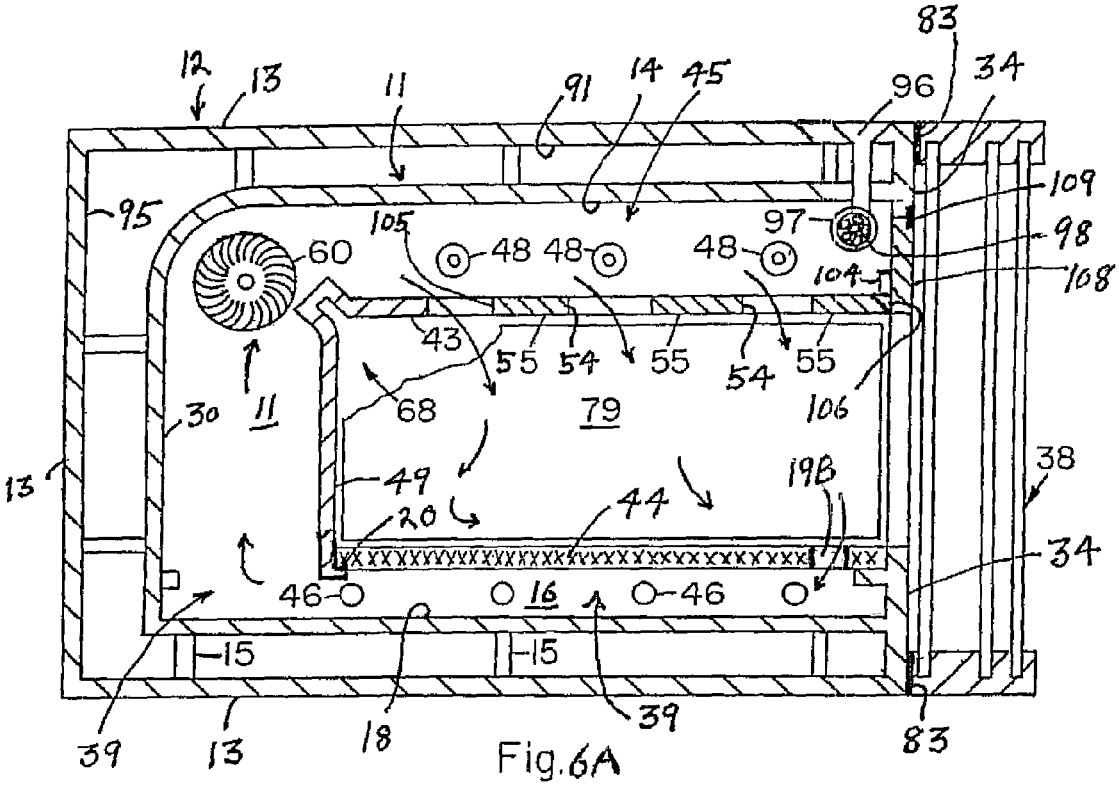
Fig.6A

COOKING OVEN

This application is a Continuation-in-Part of Applicant's application Ser. No. 11/347,982 filed Feb. 6, 2006 now abandoned and titled "COOKING OVEN", and Applicant claims priority under 35 U.S.C. 119(e)(1) based on Applicants Provisional U.S. Patent Application Ser. No. 60/661,618 filed Mar. 14, 2005 and titled "CONCEPT DESIGN FOR COMMERCIAL STYLE HOME BAKING DEVICE/OVEN", on Provisional 60/693,882 filed Jun. 24, 2005 titled "CONCEPT OVEN DESIGN", and on Provisional 60/839,643 filed Aug. 23, 2006 and titled "COOKING OVEN".

BACKGROUND OF THE INVENTION

1. Field

The present invention is directed to electrically heated convection baking ovens and the like and particularly concerns, in preferred embodiments, operator control of radiant heat emanating from heating elements and directed down into the oven cooking chamber, specially constructed and functional heated air circulating means for providing more uniform heat transfer throughout the cooking chamber, an upper heating element and a lower heating element with a ceramic or metal heat sink, specially designed partition or divider means for quickly and easily converting the oven cooking chamber from a single chamber to multiple chambers and vise versa, and in a most preferred embodiment uniquely functional electrical control means is provided for regulating heat output of the upper and lower heating elements in a reciprocal manner so as to accurately regulate the temperature of a particular are—sweet spot—within the oven cooking chamber which is most desirable for a particular product.

2. Prior Art

Conventional home ovens for the past 100 years have retained the basic cube configuration for the oven cooking chamber which is typically provided with horizontal interposed cooking racks. Other than the addition of "convection" provided by fan means and the substitution of electronic for electromechanical controls, little has changed. This basic configuration leaves considerable room for improvement.

Much oven usage involves baking, roasting or broiling of smaller size or number of food products whereby utilization of the large standard oven cavity becomes energy inefficient. Attempts at simultaneous precision baking on multiple racks is usually futile because of the unevenness in heat transfer excepting perhaps for ovens with "pure" or "European style" convection. Simply spoken, most ovens have one "sweet spot" or area that cooks with evenness and consistency for a specific product. Attempts have been made to "fine tune" this "sweet spot" by placing the racks at different heights, however, many conventional ovens still have a tendency to over cook or over brown the food product at the rear of the oven. This can be due to excessive air leaks in the oven door, excessive airflow over the product next to fan intake, or even opening the oven door multiple times to check on the product being baked.

SUMMARY OF THE INVENTION

The present invention, in one of its most preferred embodiments comprises an oven structure which provides for an oven unit comprising a single or multiple (any number) side by side ovens, wherein the multiple ovens are independently operable and are separated by generally vertical, hinged partition(s) whereby upon swinging one or more partitions back to adjacent the rear of one or more adjacent ovens the oven structure may then function as one or more large ovens, and which further provides for highly controlled heating of each cooking chamber by means of a tangential fan for each chamber with air flow therefrom directed over upper electrical heating elements by means of flow director structure ensuring laminar flow and evenness of heat transfers, wherein the flow director also functions as a radiant heat shield or occluder which is operator movable to either expose or occlude the radiant heat to each cooking chamber from the upper elements depending on the need to roast, bake, or broil the food product. Also provided are lower electrical heating elements positioned below ceramic cooking surfaces for ensuring evenness of radiant heat transfer therefrom. Also provided for is operator controlled top vs. bottom heating using a slide control that reciprocally affects the duty cycle of the top and bottom electrical heating elements, further allowing precision baking control.

The present oven structure design addresses the aforementioned prior difficulties and in addition, the design concept extends the side walls of the oven and diminishes the vertical oven height, and provides a hinged moveable vertical partition to enable the operator to vary the cooking chamber size for smaller or larger products. This allows for the oven to be employed as a single larger oven or as two or more smaller ovens. Also, independent controls for these partitioned cooking chambers enable the user to perform independent cooking tasks in each separate cooking chamber.

An even heat transfer is the hall mark of precision baking and is probably more important than the method of transfer (radiant, convective, conductive). This issue is addressed through the present invention by a number of changes or departures from the standard. For example, with the present invention, convective heat is provided by a tangential fan positioned in the rear top of the oven that blows air along its entire length. The inlet air is ducted to the fan from the bottom of the back wall of the cooking chamber and the outflow air is controlled by a flow director that channels the heated air along the top of the oven over the heating elements and down into the cooking chamber resulting in an even laminar air flow.

The flow director is constructed to function also as a radiant heat occluder to either block or expose the cooking product to direct radiant heat from the upper heating elements depending on the cooking task desired. For example, the air flow director can serve as a radiant shield for the top elements, thereby ensuring evenest in heating but can be repositioned to expose the top heating elements to the food product as would be necessary, for example for broiling. Bottom heat is provided by heating elements preferably beneath a large ceramic plate which forms the floor or bottom wall of the oven cooking chamber on which plate the food product may be placed either directly as with bread or indirectly as in a cooking vessel. The ceramic or metal plate functions as a heat sink and radiates heat evenly. A ceramic plate is preferred since it is a poor heat conductor and thus prevents burning of the bottom of the food product.

All of the above features of the present invention, in combination, ensure an even heat distribution to the food product. Also, the ultimate in precision baking is the ability to reciprocally adjust the heat delivery from upper and lower heating elements of each oven. This is accomplished by the present invention by means of, e.g., a slide switch (variable resistor) and an appropriate electrical circuit that increases or decreases the cycle time to the upper and lower heating elements in a reciprocal fashion. For example, adjusting the switch upwardly would concomitantly increase the duty cycle of the upper elements and decrease the duty cycle of the lower elements. Preset temperature would be maintained thereby but the top of the product would be exposed to more heat, much like moving the conventional oven rack up or down. Examples would be cooking a steak with the slide switch in the full up position with the heat being generated exclusively by the upper elements such as to effect broiling. In cooking a pizza for example, the switch would be far down to effectively brown the crust.

The present ovens can be mounted under shelf, or over the stove cooking surface with appropriate venting provided, or over the counter top. This makes the baking process more convenient in minimizing bending or stooping and allows the user to more easily produce the exact "brownness" of the cooked products especially breads, particularly where the provision of a large glass door enhances visualization. In this regard, ease of visualization is provided by the oven being just below eye level and by large transparent doors.

BRIEF DESCRIPTION OF DRAWINGS

The present invention will be understood further from the following description and drawings wherein certain structures are shown in exaggerated dimensions for purposes of clarity, wherein the figures are not in structural proportion to each other, wherein their structural appearance in the drawings does not, in any way, restrict their methods of manufacture, and wherein:

FIG. 6A is a view as in FIG. 6 but showing air inlet 19B positioned at the lower front portion of the oven;

FIG. 6B is a top view of the heat sink plate of FIG. 6A;

DETAILED DESCRIPTION

Figure 1:
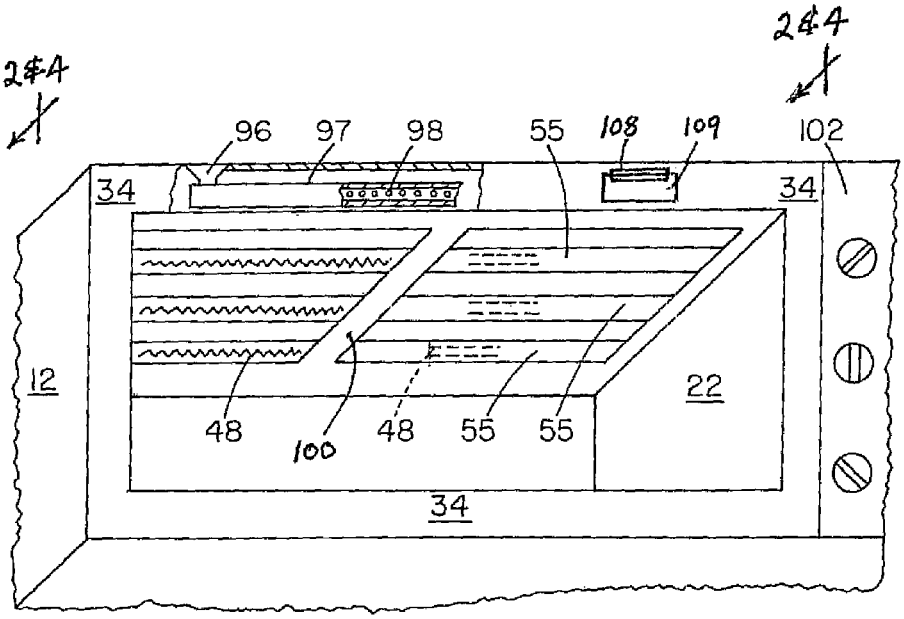
FIG. 1 is a frontal isometric view of the present oven with the oven divider or partition and front access door removed for clarity.

Referring to the drawings which represent the preferred and best mode for practicing the present invention, the various wall structures are shown as monolithic, however, fabrication in sections of these structures in conventional manner can be employed. As shown, the present cooking oven structure comprises a single (FIG. 1) or side by side multiple ovens (FIGS. 2-10), wherein each oven comprises spaced inner 10 and outer 12 metal housings formed respectively by first wall means 11 and second wall means 13. First wall means 11 provides the structural elements of a ceiling 14, a floor 18, opposing side walls 22, 24, a back wall 30, and front wall portions 34 provided with a hinged access door 38.

For each oven, the combination of an upper heating cavity 45 communicating with a circulating air feed channel generally designated 39 is formed (for oven "C" see FIGS. 3 and 6) by side walls 22 and 24, back wall 30 and ceiling 14 of first wall means 11, by third wall means 41 having a generally horizontal upper section 43 spaced inwardly downwardly from ceiling 14 and having a generally vertical rear section 49 spaced inwardly forwardly from said back wall 30, and by portion 103 of heat sink plate 44. It is noted that the terms generally horizontal or generally vertical or the like as used herein are to be given wide latitude since the structures can be slanted or the like depending on design needs.

Similarly, for oven "D" with portion 103 (FIG. 6) of heat sink plate 44 removed, channel 39 is formed by wall portions or sections 22, 24, 30, 49 and floor 18. Similarly for the oven of FIG. 6A, channel 39 is formed by wall portions or sections 22, 24, 30, 49 and then also by floor 18.

The heat sink ceramic or steel plate means 44 is adapted to provide a predeterminable heat supply and is spaced upwardly from floor 18 and forms with wall means 11 a lower heating cavity 16. Rear section 49 in oven "C" (FIG. 3) is spaced upwardly from plate means 44, e.g., 0.5-2.0 in. to provide a circulating air outlet 19 to channel 39. In oven "D", air outlet 19A to channel 39 is preferably provided by removing the inner portion 103 (FIG. 6) of plate 44 in order to allow partition 79 to swing to its full open position adjacent wall 41 to form a single enlarged oven without impeding air flow into channel 39. These structural elements of the inner housing, third wall means 41 and ceramic heat sink plate define the cooking chambers 40.

In FIG. 6A, circulating air outlet 19B to channel 39 being positioned at the front portion of all ovens in the group, e.g., "C" and "D", allows the air to circulate all the way to the front of the cooking chambers as well as over the lower heating elements thereby diminishing typical, cold spots near the oven front and whereby air flow is in contact with both upper and lower heating elements which thereby further improves heat transfer and heating efficiency. Such outlet 19B can be provided by simply removing a lateral front portion, e.g., 0.5-2.0 in. of plate 44, or by slotting the plate, e.g., 0.5-2.0 in. wide, substantially all the way across a front portion of the plate as shown in FIG. 6B, both alternatives as well as outlets 19 and 19A and other equivalent structures being designated as a gap means.

The outer housing 12 and second wall means 13 comprises a top or ceiling 91, end (side) walls 92, 93, floor 94 back wall 95, and front wall portions 34 common with portions 34 of first wall means 11 which interconnect the front perimeter portions of the inner and outer housings. A typical set of approximate dimensions for the present oven structure for an expanded oven from dual ovens where the partition means has been hinged back against the rear section 49 are as follows:

| | |
|---|---|
| (a) oven structure outside width | 36.0" |
| (b) oven structure outside depth | 17.2" |
| (c) oven structure outside height | 12.0" |
| (d) oven structure interior width | 30.0" |

-continued

| | |
|---|---|
| (e) oven structure interior depth | 14.0" |
| (f) oven structure interior height | 9.0" |

The center partition means 79 hinges back against the rear wall section 49 to create an enlarged cooking chamber approximately 30 in. wide, 14 in. deep and 9 in. high. Heat insulation material 42 such as glass wool is positioned between said housings in conventional manner.

A first electrical resistance heating means such as elements 46 for plate means 44 is positioned under the plate within lower heating cavity 16. A second electrical resistance heating means such as elements 48 is positioned under ceiling 14 within upper heating cavity 45. Heat radiation shielding means generally designated 50 is positioned between heating means 48 and upper section 43 of said third wall means. This shielding means 50 in a preferred structure comprises base or support ledges 51 formed from grooves 52 in the side walls 22,24, and a slide plate 53 having inner and outer ends 105 and 106 respectively, with push-pull tab 104, and formed to provide air flow slots 54 therethrough bordered by shielding lands 55 and having slot ends 107. Plate 53 is slidably supported on the ledges 51 and is operator slidable with respect to heating coils or the like elements 48 between a heat radiation blocking position 56 (FIG. 3) and a heat radiation non-blocking position 58 (FIG. 3) with respect to cooking chamber 40. Operator access to tabs 104 is provided by, e.g., a small hinged 108 door 109, preferably spring urged to closed position, such as 108 mounted on front wall portion 34 of each oven.

An air flow circulating fan 60 communicating with the cooking chamber 40 and the upper heating cavity 45 is adapted to cycle (circulate) air from the cooking chamber thru outlet 19, 19A or 19B into the air feed channel 39, into upper heating cavity 45, over the heating elements 48, down thru slots 54 into the cooking chamber 40 and across plate means 44 and then back thru said outlet to complete the circulation cycle.

The housings 10 and 12 are of conventional construction such as, e.g., 14-26 gauge sheet steel which can be ceramic glazed or otherwise coated with high temperature resistant paint or the like material. In the drawings the structures appear as thick monolithic castings for purposes of clarity, however the sheet metal joints can be made by conventional techniques of welding, brazing, metal interlocking crimping, rivets, sheet metal screws or the like.

Figure 6:
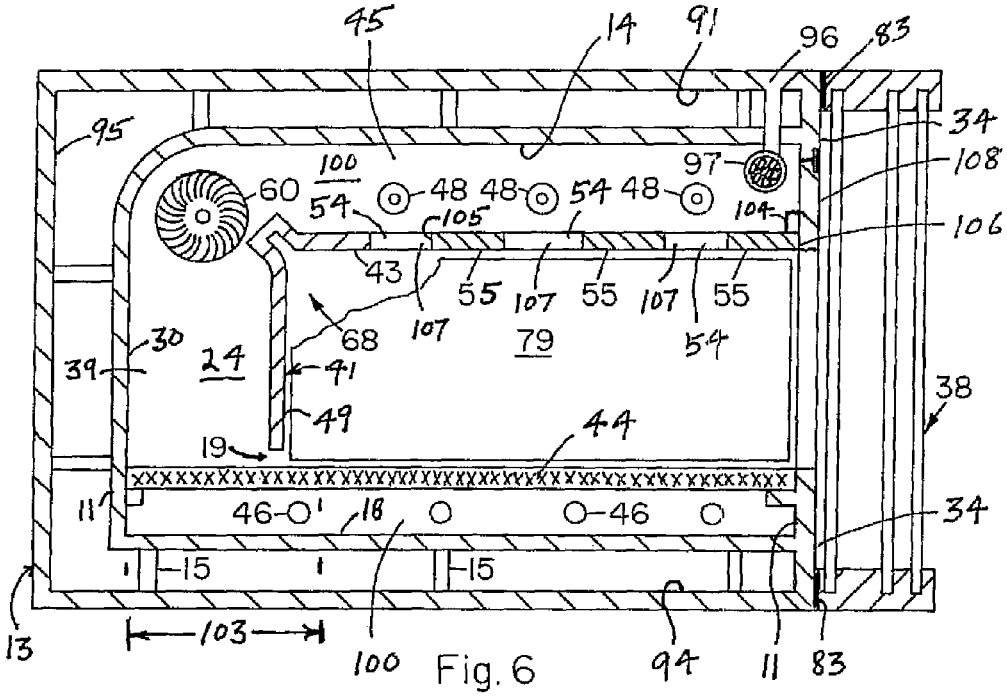
FIG. 6 is a cross-sectional view taken along line 6-6 in FIG. 3.
Figure 7:
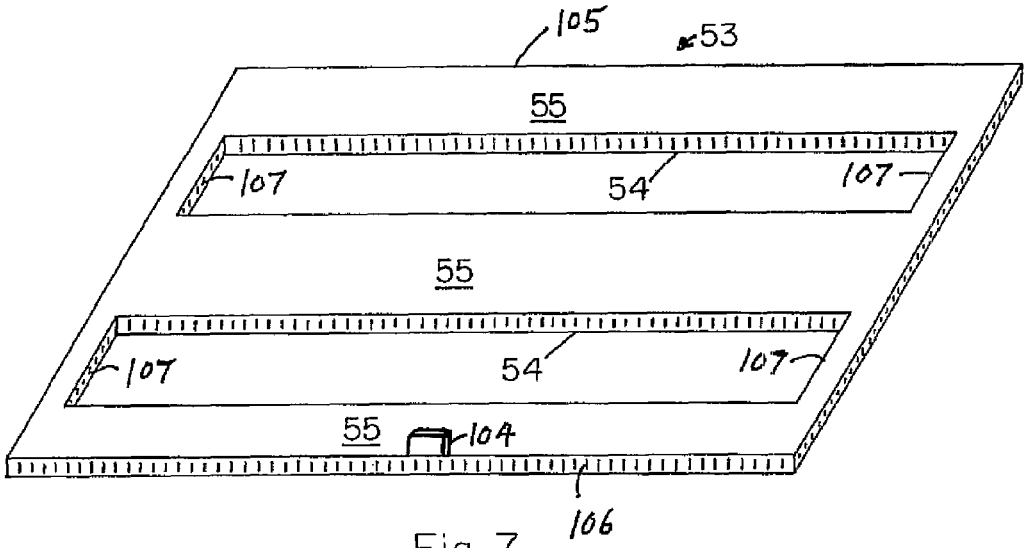
FIG. 7 is an isometric plan view of the heat radiation shielding or blocking occluder slide plate of FIGS. 5 and 6.

A steam injection system such as shown and described in U.S. Pat. No. 6,860,261 B2 is preferably used with the present invention and is shown in FIG. 6 as a water inlet tube 96 extending between walls 11 and 13 and connected to a steam generating tube 97 containing stainless steel balls 98. A conventional oven light 99 is set into the oven side wall.

Figure 2:
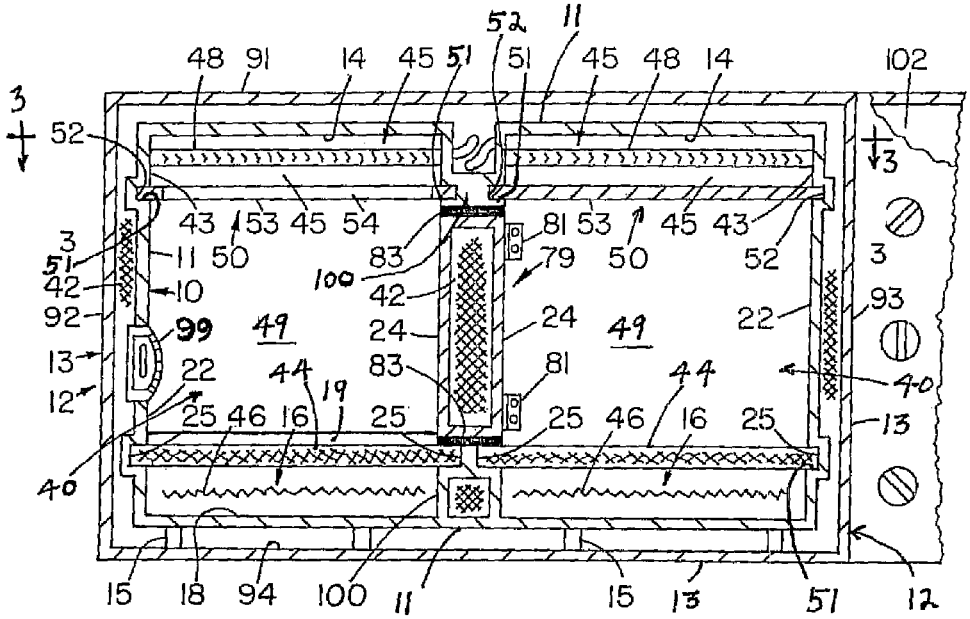
FIG. 2 is a cross-sectional view of a double oven taken along line 2-2 in FIG. 1 with the oven partition means in place.
Figure 2A:
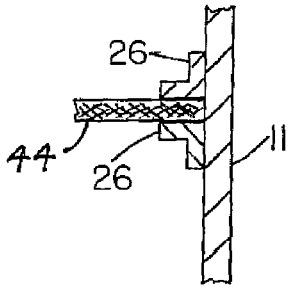
FIG. 2A is a cross-section of an alternative mounting for the heat sink plate.

As shown in FIG. 2, metal spacers 15 or an equivalent structure can be placed and fixed strategically to the inner and outer housings to maintain a rigid spacing and connection between the two housings and for providing dimensioned spaces for containing the insulation material 42. Side walls 22 and 24 and center support 100 (part of first wall means 11) are shown as grooved as at 52 for supporting slide plate 53, and these elements are further grooved at 25 for supporting heat sink plate means 44, however other structures such as elongated metal or ceramic angle members such as 26 welded or riveted to first wall means 11 as shown in FIG. 2A may be employed.

Figure 4:
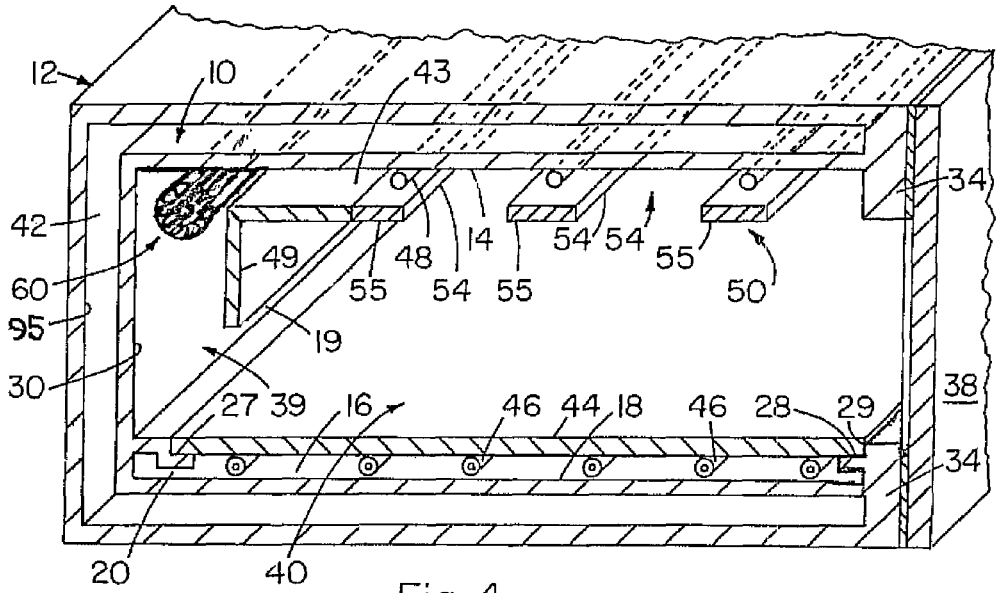
FIG. 4 is an isometric cross-sectional view taken along line 4-4 of FIG. 1 but rotated clockwise about 40°.
Figure 4A:
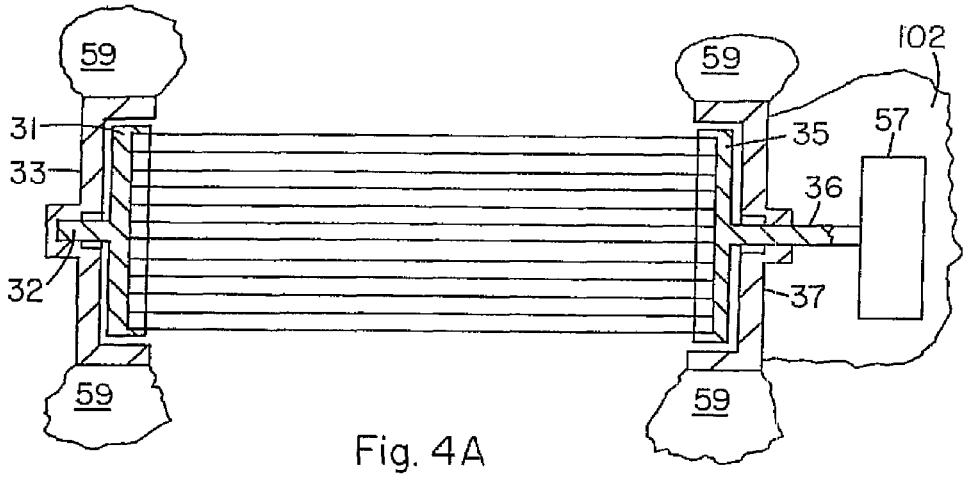
FIG. 4A is a longitudinal cross-sectional view of a typical tangential fan.

Referring to FIG. 4, the ceramic plate rear support 20 comprises a lateral ledge such as 27 at the back of the cooking chamber and 28 at the front thereof. It is noted that the shallow ledge 28 allows the plate to be slid into grooves 25 if there is sufficient looseness in the fit of the plate therein such as to accommodate the small drop down 29. This structure locks the plate horizontally in place. The ceramic plate preferably consists of Silica based comminuted material and has a thickness of from about 0.3 to about 1.5 in., most preferably from about 0.5 to about 0.75 in.

It is preferred to provide some type of gripping structure such as metal or ceramic tab 104 on the front of each slide plate 53 to allow the chef to easily slide the plates in or out with respect to heating elements 48.

Each heating means 46 and 48 and thermocouple sensors therefor can be selected from any commercially available types including the finned or tubular heaters and thermocouples as described in the 1999-2005 Watlow Electric Manufacturing Company brochures from WATLOW, 5710 Kenoshat Street, Richmond, Ill. 10071. The doors and handles can be selected, for example, from those shown in the Jun. 23, 2005 brochures of Mills Products, Incorporated, 219 Ward Circle, Suite 2, Brentwood, Tenn. 37027.

The air circulating fan 60 most preferably is a cross flow or tangential blower type as described in the Jun. 23, 2005 brochure of EUCANIA International, Inc. Such fans give an even laminar air flow from back to front substantially completely across (side to side) of the present oven which greatly facilitates temperature control by the present invention throughout the oven cooking chamber.

Figure 5:
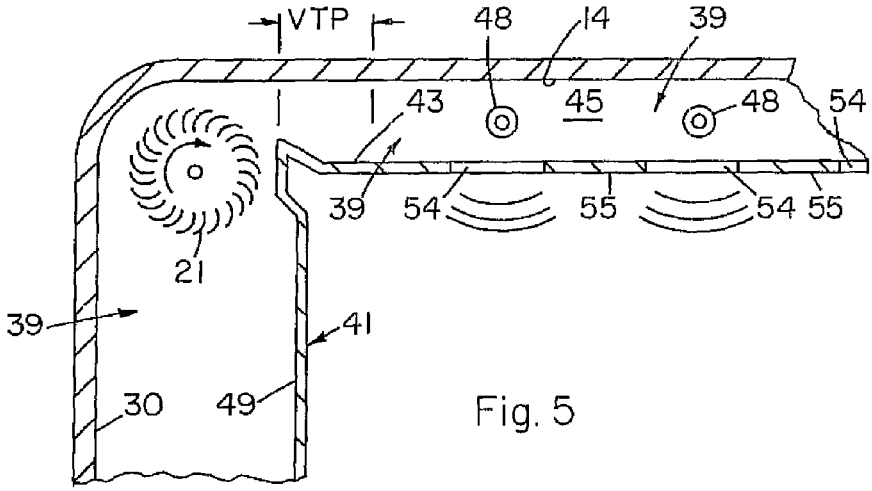
FIG. 5 is a cross-sectional taken along line 5-5 in FIG. 3 depicting circulating air flow paths and a non-blocking position of a portion of the occluder slide plate.

An example of these fans for use in the present invention, referring to FIGS. 3, 4, 4A and 5, comprises a plurality, e.g., 10-30 elongated blades 21 of about 18 in. length and about ⅜-¼ in. width as shown in FIG. 5 and having a radiused curvature and fixed in a circle of about 1.6 in. OD at one end into a disc 31 having a shaft 32 which is rotatably mounted in a bearing housing 33. The other end of the blades are fixed into a disc 35 having a shaft 36 which is rotatably mounted in a bearing housing 37. Shaft 36 comprises, e.g., the output shaft of an electrical motor 57. Bearing housing 33 and 37 are attached to and fixed in position relative to each other by wall means 11 such as portions 59 thereof into which shafts 32 and 36 are respectively mounted. It is noted that where the oven dimensions require long, e.g., 18 in. tangential fans, supporting discs preferably are used to support the blades and fix them in position relative to each other in the middle or other intermediate positions of their length. In order for the fan to have its maximum efficiency, the most preferred configuration for upper wall section 43 is shown in FIG. 5 wherein the fan outlet side is adjacent a vortex tongue portion of 43 delineated "VTP".

Figure 8:
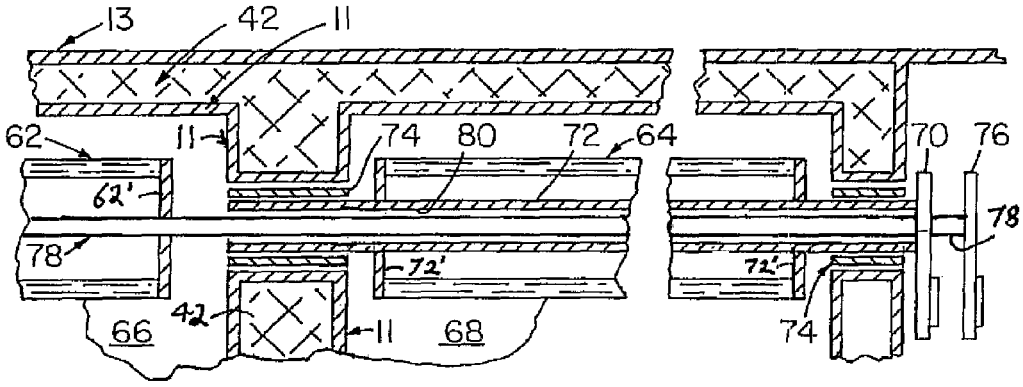
FIG. 8 is a cross-sectional view taken along the axis of a portion of the upper heating cavity and the axis of the two circulating fans showing a coaxial drive mechanism for selectively operating the separate fans.

Referring to FIG. 8 which is semi-exploded view for clarity, two tangential fans 62,64 are used for the two oven chambers 66 and 68 respectively. The drive motor 70 for fan 64 has a tubular drive shaft 72 fixed to the fan disc ends 72' and rotatably mounted in bearings 74 fixed in first wall means 11. The drive motor 76 for fan 62 has drive shaft 78 fixed to the fan disc ends 62' and rotatably mounted thru the bore 80 of shaft 72.

Figure 9:
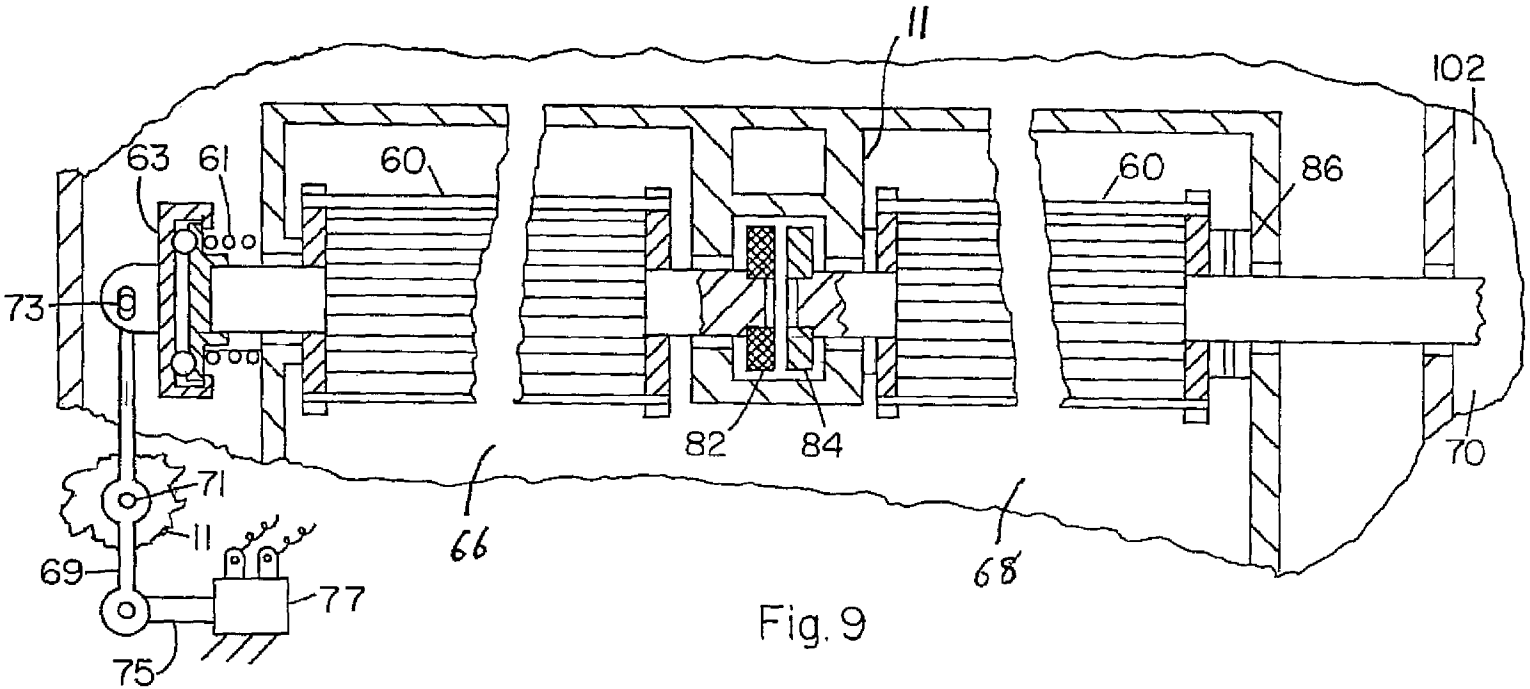
FIG. 9 is a cross-sectional view as in FIG. 8 showing a clutch type of driving means for the separate fans.
Figure 10:
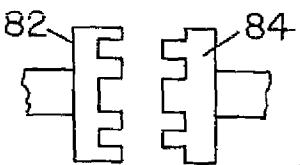
FIG. 10 is a variation of the clutch engaging faces of FIG. 9.
Figure 11:
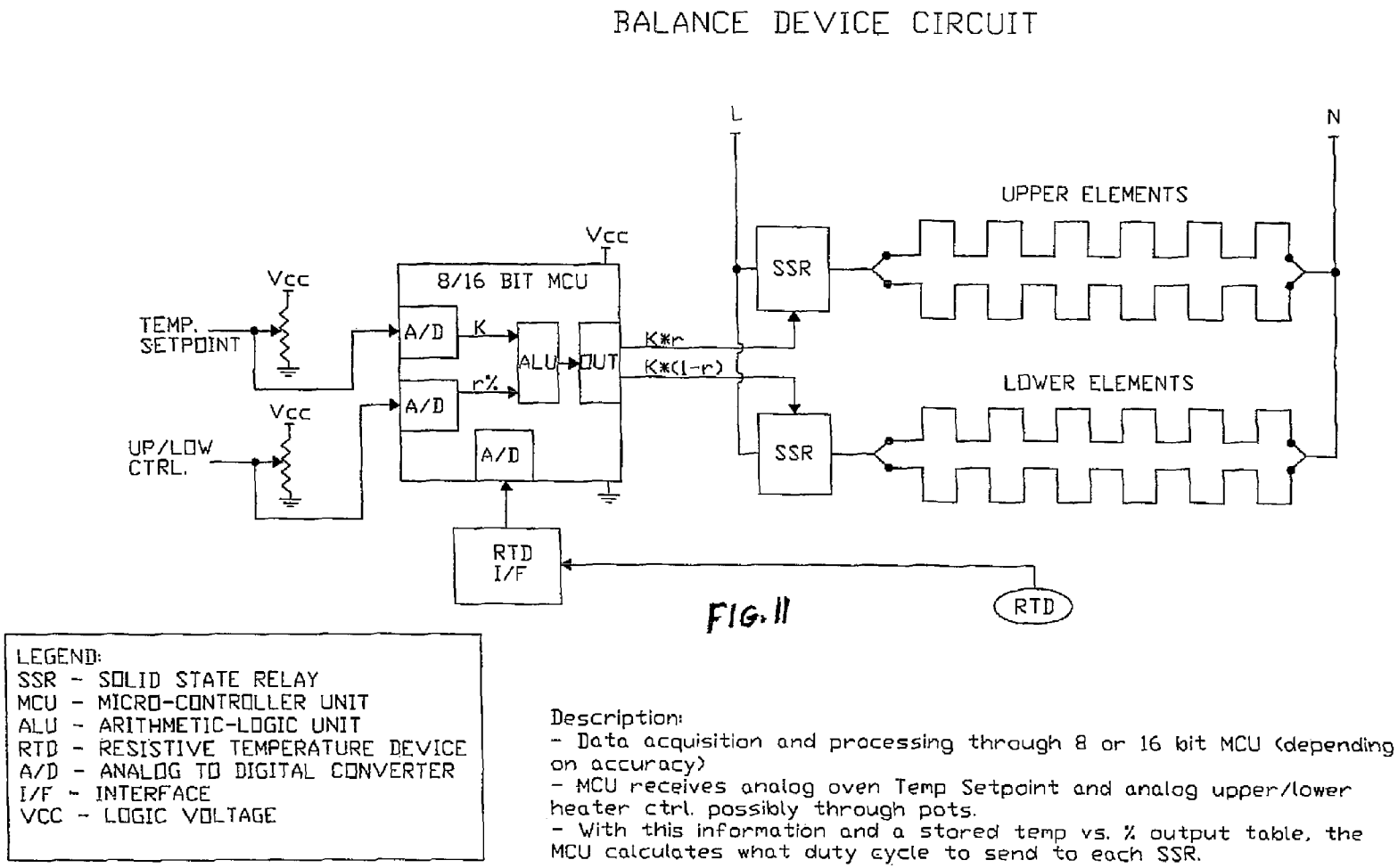
FIGS. 11 and 12 are schematic electrical circuits for operating the present oven structure by reciprocating balance of the heat output of the upper and lower heating elements.
Figure 12:
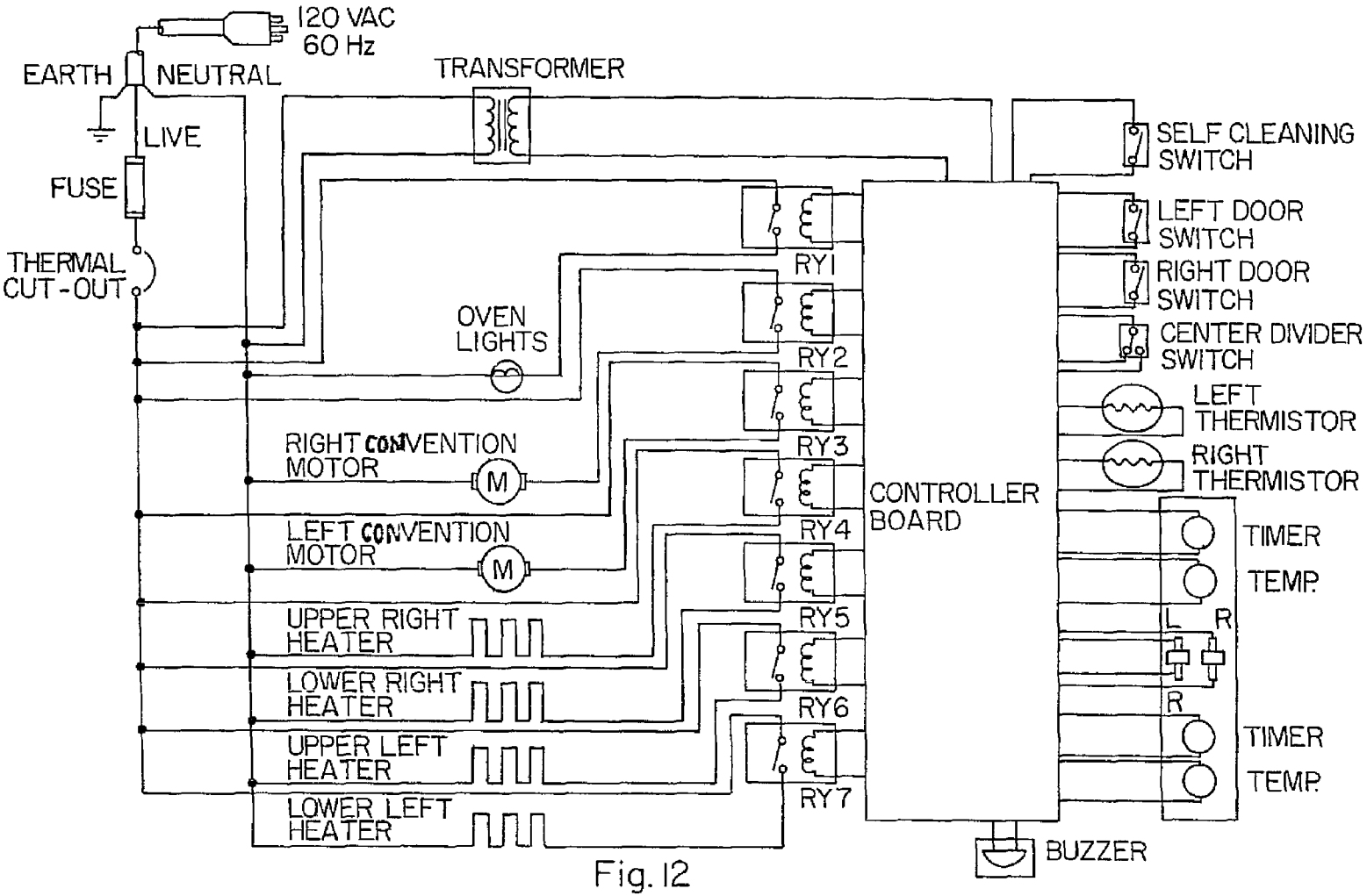

Referring to FIGS. 9 and 10 the separate fans of separate ovens are clutch driven by clutches of FIG. 9 or FIG. 10 or any other conventional clutch faces. In this embodiment equivalent structures to those of FIGS. 3, 4, 4A and 5 are numbered the same.

In FIG. 9, the adjacent ends of the drive shafts are provided one with a friction clutch disc 82 and the other with, e.g., a smooth steel faced disc 84. In this fan drive version, a thrust bearing 86 is provided to reduce endwise friction when the clutch is engaged. A compression spring 61 and thrust bearing 63 are provided to ensure release of the clutch when only on fan is to be operated. The clutch is actuated to drive both fans by means of a lever 69 pivotally mounted at 71 to a stationary portion of the oven and at 73 to thrust bearing 63. Lever 69 may be connected to the armature 75 of a solenoid 77 incorporated, e.g., into the electronic control system for the oven. Alternatively, the lever may extend outwardly thru the oven front for manual operation.

Figure 3:
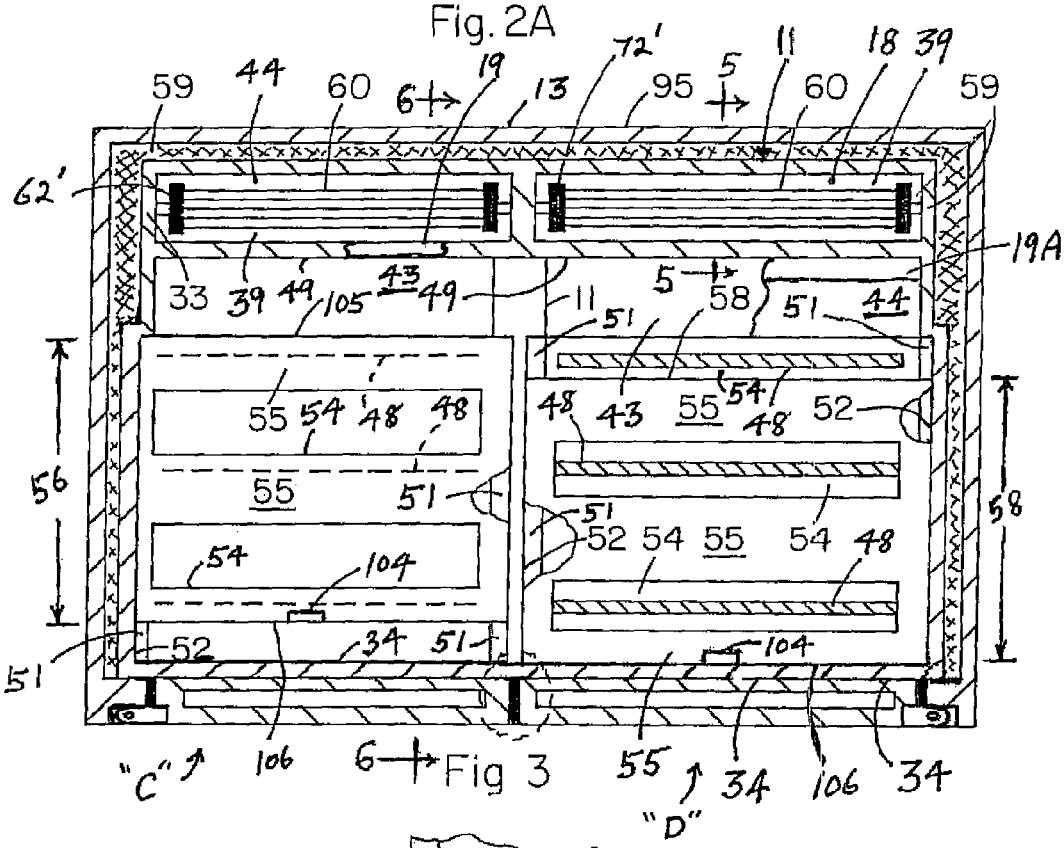
FIG. 3 is a cross-sectional view taken alone line 3-3 in FIG. 2.

Referring to FIGS. 2 and 3, a partition means generally designated 79 providing aforesaid side walls 24 is mounted on back wall 30 by hinges 81 of any convenient type such that it can be swung back against wall 30 by a user when it is desired to use a single larger cooking chamber. This partition means preferably is hollow core as shown containing heat insulation material 42. Strips 83 of firm heat insulation adhesive material can be used along the top, bottom, front and rear of the partition to assist in isolation of the two chambers as desired. The strips can also be held in place by conventional mechanical means.

Figure 3A:
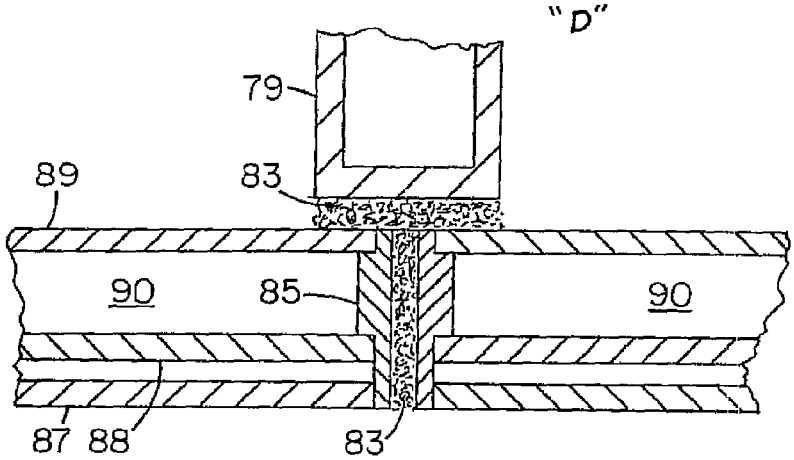
FIG. 3A is an enlarged cross-sectional view of the dotted area in FIG. 3.

Referring to FIG. 3A the oven doors 38 most preferred comprise a frame 85 surrounding and fixed to an outer glass panel 87, a middle glass panel 88, and an inner glass panel 89. The cavity 90 is vented to protect against excessive heat generated air pressure. A heat insulating—sealing strip such as 83 can be affixed to one or both doors where desired. Conventional hinge means and latching means for the door are employed.

The invention has been described in detail with particular reference to preferred embodiments thereof, but it will be understood that variations and modifications will be effected with the spirit and scope of the invention.

I claim:

1. A cooking structure having a single or side by side multiple ovens wherein each oven is formed with a cooking chamber adapted to be closed to outside fresh air during operation, each said oven comprising first wall means forming an inner housing, second wall means forming an outer housing spaced from said inner housing, each said housing comprising the structural wall portions of a ceiling, a floor, opposing sides, a back and a front, which wall portions enclose and seal the space between said first and second wall means to fresh outside air, heat insulating material in said space to provide a heat insulating barrier, said front structural portions forming an oven access perimeter structure against which an access door to said cooking chamber can be mounted, third wall means positioned within said inner housing and having an upper generally horizontal first wall section spaced downwardly from said ceiling of said inner housing and sealed at its front against said front wall portions, said third wall means further having a generally vertical rear second wall section spaced forwardly inwardly from said back wall portion of said inner housing, said first and second wall sections extending laterally across said cooking chamber and engaging said opposing sides, substantially flat surfaced, food item supporting plate means mounted within said inner housing and extending over a substantial portion of the floor of said inner housing for providing a heat sink and food item support and floor portion of said inner housing and forming a lower substantially sealed heating cavity, said first and second wall sections in conjunction with said first wall means and said plate means providing a captured air circulating duct which is sealed to outside fresh air and comprising a combination of an upper heating cavity communicating with a circulating air feed channel, wherein said structural portions of said inner housing, third wall means and plate means delimit and structurally define said cooking chamber, aperture means formed thru said horizontal first wall section to allow circulating captured air to flow therethrough down into said cooking chamber, recirculating captured air outlet gap means thru at least one of said supporting plate means or said second wall section of said third wall means for placing said cooking chamber and said captured air circulating duct into air flow communication, a first electrical resistance heating means positioned under said supporting plate means within said lower heating cavity, a second electrical resistance heating means positioned under said ceiling of said inner housing within said upper heating cavity, heat radiation shielding means positioned between said second electrical resistance heating means and said horizontal first wall section of said third wall means and being operator moveable with respect to said second electrical resistance heating means and said aperture means, between a heat radiation shielding position and a non-shielding position with respect to said cooking chamber, captured air flow circulating means communicating with said cooking chamber and said circulating air feed channel and adapted to circulate captured air from said cooking chamber into said circulating air feed channel, then into said upper heating cavity, then over said second electrical resistance heating means, then thru said aperture means down into said cooking chamber and across said supporting plate means, and then thru said air outlet gap means and back into said circulating air feed channel.

2. The cooking structure of claim 1, wherein electrical control means is provided for adjusting a heat output of each of said first and second electrical resistance heating means.

3. The cooking structure of claim 2, wherein the control means automatically adjusts said heat output of said first and second heating means in a reciprocal manner.

4. The cooking structure of claim 2, wherein control means is provided for regulating air flow volume from said circulating means.

5. The cooking structure of claim 1, wherein the air flow circulating means comprises a tangential convection fan mounted in said upper heating cavity adjacent to the conjunction of said ceiling and said back wall portion of said inner housing with the rotation axis of said fan being substantially parallel to the junction of said rear wall portion and said ceiling.

6. The cooking structure of claim 5, comprising multiple side by side ovens within said inner and outer housings have unitary or interconnected ceiling, floor, front wall and back wall structures, wherein partition means separates the oven cooking chambers, said partition means being hingedly mounted on said back wall for being swung back to adjacent said back wall structure to enlarge the cooking cavity.

7. The cooking structure of claim 6, wherein the fan of each oven is driven by a separate and independently operable drive motor.

8. The cooking structure of claim 6, wherein the fan of each oven is adapted to be driven by a single drive motor and wherein a clutch mechanism is provided for an operator to selectively drive one or both of said fans with said motor.

9. The cooking structure of claim 1, wherein the air outlet gap means is provided at a front portion of said heat sink plate in close proximity to said oven access and wherein said plate has a substantially flat surface and is monolithic in structure.

10. The cooking structure of a single oven of claim 1, wherein the outlet gap means is provided in proximity to the bottom of said generally vertical rear second wall section.

* * * * *